US008245513B2

(12) United States Patent
Huth et al.

(10) Patent No.: US 8,245,513 B2
(45) Date of Patent: Aug. 21, 2012

(54) COMBUSTION CHAMBER

(75) Inventors: Michael Huth, Essen (DE); Peter Tiemann, Unna (DE); Iris Oltmanns, legal representative, Unna (DE)

(73) Assignee: Siemens Aktiengesellschaft, München (DE)

( * ) Notice: Subject to any disclaimer, the term of this patent is extended or adjusted under 35 U.S.C. 154(b) by 1025 days.

(21) Appl. No.: 10/558,893

(22) PCT Filed: Apr. 27, 2004

(86) PCT No.: PCT/EP2004/004442

§ 371 (c)(1),
(2), (4) Date: Oct. 13, 2006

(87) PCT Pub. No.: WO2004/106809

PCT Pub. Date: Dec. 9, 2004

(65) Prior Publication Data

US 2007/0062198 A1 Mar. 22, 2007

(30) Foreign Application Priority Data

May 30, 2003 (EP) ..... 03012441

(51) Int. Cl.
*F02C 1/00* (2006.01)

(52) U.S. Cl. ..... 60/752; 60/755

(58) Field of Classification Search ..... 60/752–760; 431/11, 161–167, 242, 243, 350, 353
See application file for complete search history.

(56) References Cited

U.S. PATENT DOCUMENTS

| | | | | |
|---|---|---|---|---|
| 3,589,128 | A * | 6/1971 | Sweet | 60/757 |
| 3,844,116 | A | 10/1974 | Matto | |
| 4,622,821 | A * | 11/1986 | Madden | 60/757 |
| 5,187,937 | A * | 2/1993 | Stevens et al. | 60/752 |
| 5,515,680 | A * | 5/1996 | Fujimura et al. | 60/737 |
| 5,644,918 | A * | 7/1997 | Gulati et al. | 60/725 |
| 5,758,504 | A * | 6/1998 | Abreu et al. | 60/754 |
| 5,802,241 | A * | 9/1998 | Oshima | 386/46 |
| 5,826,429 | A * | 10/1998 | Beebe et al. | 60/723 |
| 6,122,917 | A * | 9/2000 | Senior | 60/752 |
| 6,170,266 | B1 * | 1/2001 | Pidcock et al. | 60/755 |
| 7,080,515 | B2 * | 7/2006 | Wasif et al. | 60/737 |
| 2002/0108375 | A1 | 8/2002 | Johnson et al. | |

FOREIGN PATENT DOCUMENTS

| | | |
|---|---|---|
| EP | 0 597 137 A1 | 5/1994 |
| EP | 1 312 865 A1 | 5/2003 |
| GB | 2 373 319 A | 9/2002 |

* cited by examiner

*Primary Examiner* — Ehud Gartenberg
*Assistant Examiner* — Gerald Sung

(57) ABSTRACT

The invention relates to a combustion chamber of a gas turbine, inside of which a supplied fuel is reacted with supplied combustion air in order to produce a working medium. The inside of the combustion chamber wall is provided with a lining formed from a number of heat shield elements. The or each heat shield element, together with the combustion chamber wall, forms an interior space that can be subjected to the action of a coolant. The aim of the invention is to provide a combustion chamber with a comparatively simple design that has a high system efficiency. To this end, the invention provides that a flow element is placed in the respective interior space while serving to effect a locally specific control of the flow of coolant.

16 Claims, 5 Drawing Sheets

COMBUSTION CHAMBER

CROSS REFERENCE TO RELATED APPLICATION

This application is the US National Stage of International Application No. PCT/EP2004/004442, filed Apr. 27, 2004 and claims the benefit thereof. The International Application claims the benefits of German Patent application No. 03012441.6 DE filed May 30, 2003, both of the applications are incorporated by reference herein in their entirety.

FIELD OF THE INVENTION

The invention relates to a combustion chamber for a gas turbine, the combustion chamber wall of which is provided on the inside with a lining formed from a plurality of heat shield elements, wherein the heat shield element or each heat shield element forms an inner space which can be subjected to the action of a cooling medium. The invention further relates to a gas turbine having a combustion chamber of said kind.

BACKGROUND OF THE INVENTION

Combustion chambers form part of gas turbines, which are used in many fields for driving generators or machines. In such applications the energy content of a fuel is used to generate a rotational movement of a turbine shaft. For this purpose the fuel is combusted by burners in the combustion chambers connected downstream thereof, with compressed air being supplied by an air compressor. As a result of the combustion of the fuel a highly pressurized working medium is produced at a high temperature. Said working medium is directed into a turbine unit connected downstream of the combustion chambers, where it expands in a manner that delivers work output.

In this arrangement a separate combustion chamber can be assigned to each burner, whereby the working medium flowing out of the combustion chambers can be combined before or in the turbine unit. Alternatively, however, the combustion chamber can also be implemented in what is known as an annular combustion chamber design, in which a majority, in particular all, of the burners open out into a common, typically annular, combustion chamber.

In addition to the attainable output power, one of the design goals in the design of gas turbines of said kind is a particularly high level of efficiency. In this case an increase in efficiency can basically be achieved for thermodynamic reasons through an increase in the exit temperature at which the working medium flows out of the combustion chamber and into the turbine unit. For this reason temperatures of around 1200° C. to 1500° C. are aimed at and also achieved for gas turbines of said kind.

With the working medium reaching such high temperatures, however, the components and parts exposed to this medium are subject to high thermal stresses. In order nonetheless to ensure a comparatively long useful life for the affected components while maintaining high reliability, it is usually necessary for said components, in particular the combustion chamber, to be constructed of particularly heat-resistant materials and for a means of cooling them to be provided. In order to prevent thermal deformations of the material which limit the useful life of the components, efforts are usually made to achieve as uniform a cooling of the components as possible.

For this purpose the combustion chamber wall is typically lined on its inside with heat shield elements which can be provided with particularly heat-resistant protective layers and which are cooled through the actual combustion chamber wall. Toward that end, a cooling method also known as "impingement cooling" can be employed. With impingement cooling a cooling medium, generally cooling air, is supplied to the heat shield elements through a plurality of holes drilled in the combustion chamber wall so that the cooling medium impinges essentially vertically onto its cooling surface formed on the cold side and facing the combustion chamber wall. The cooling medium heated up by the cooling process, e.g. cooling air, is subsequently discharged from the inner space that the combustion chamber wall forms with the heat shield elements. A further cooling process in which a longitudinal backflow of the heat shield elements along a cooling surface facing the combustion chamber wall is used, is the technique known as convective cooling.

SUMMARY OF THE INVENTION

The object of the invention is to specify a combustion chamber of the aforementioned type which, while being of comparatively simple construction, is suitable for a particularly high system efficiency and in which at the same time the areas exposed to high temperatures can be cooled effectively. A gas turbine with the aforementioned combustion chamber is also to be specified.

With regard to the combustion chamber, this object is achieved according to the invention by a combustion chamber for a gas turbine whose inner wall is provided on the inside with a lining formed by a plurality of heat shield elements, the heat shield element or each heat shield element forming an inner space which can be subjected to the action of a cooling medium and in which a flow element is inserted for selective adjustment of a cooling medium stream.

The invention proceeds from the knowledge that once a structural configuration of a combustion chamber has been completed, the geometry of the inner space formed for cooling purposes is fixed. When subjected to the action of cooling medium, therefore, the inner space provided for this purpose is filled and flowed through essentially uniformly. An adjustment of the cooling power to the actual local cooling medium requirement of a heat shield element is consequently not possible. For this reason the application of the cooling medium to the inner space for the purpose of cooling the heat shield element is extremely nonspecific, since it cannot be adjusted sufficiently flexibly to the respective actual local cooling requirements. The heat dissipation from the inner space is adjustable within certain limits only by means of the total amount of the cooling medium supplied to the intermediate space per time unit. However, the main focus of attention in conventional inner space cooling is on a reliable and uniformly full-coverage application of the cooling medium to the heat shield elements, in particular with regard to a particularly high level of system efficiency.

By this conventional method the cooling medium is disadvantageously applied to areas of the heat shield element with a locally lower cooling medium requirement to the same extent as those areas that are subjected to higher temperatures, with the result that cooling medium in excess of the actual requirement is used.

By means of the invention, on the other hand, a new way is revealed for the first time to achieve an adjustment of the cooling power to the local requirements in the inner space. An operationally determined cooling adjustment is advantageously possible through the insertion of a flow element even after the configuration of the combustion chamber has been completed—that is to say when the geometry of the combustion chamber has been specified. In this arrangement the flow element in the inner space acts directly on the cooling medium stream in the inner space and leads to selective adjustment of the latter with regard to strength and flow direction such that the heat shield element can be cooled according to requirements. As a result thereof the cooling efficiency is increased.

In a particularly preferred embodiment of the combustion chamber a flow channel for cooling medium is formed by the flow element, in which flow channel the flow velocity of the cooling medium stream is increased compared with the flow velocity upstream of the flow element. The flow element disposed in the inner space accordingly leads to a local increase in the flow velocity of cooling medium in the flow channel. As a result of the increased flow velocity an increase in heat transfer is accordingly achieved locally from the thermally heavily loaded heat shield element to the cooling medium, e.g. cooling air. In this case the flow channel is advantageously bounded immediately by a wall to be cooled of the heat shield element. The heat transfer into the cooling medium and the heat dissipation are assisted by the increased flow velocity. The increase in flow velocity is produced for example as a result of a local reduction in the flow cross-section caused by the flow element in the inner space. The insertion of a, in the simplest case, approximately planar flow element having a predefined wall strength into the inner space immediately produces for example a reduction in the gap dimension of the passage channel for the cooling medium by the amount of said wall thickness. In the area of the reduced gap dimension this leads to an increase in the flow velocity of the cooling medium locally and hence to an increase in cooling power.

A heat shield element is preferably assigned a respective flow element for cooling a thermally heavily loaded wall section of the heat shield element. In this way an individual selective adjustment of the cooling medium stream is ensured for each heat shield element for cooling according to requirements. In this case the arrangement and the structural configuration of the flow element for cooling adjustment of a heat shield element is such that the flow channel formed hereby for the cooling medium supplies a wall section having an increased temperature loading in the operation of the combustion chamber with cooling medium. As a result of the increased velocity in the flow channel this wall section specifically is cooled more intensively. In other wall sections, by contrast, this is not necessary and a reduced flow velocity is sufficient.

For example, the heat shield element that can be cooled in this way can have a longitudinal axis and a transverse axis and comprises a wall having a hot side which has a hot side surface which can be subjected to the action of a hot medium, e.g. hot combustion gas, and also a cold side opposite the hot side. In this arrangement the cold side is the side of the heat shield element facing toward the combustion chamber wall and delimits the inner space. In this case the heat shield element can comprise a first wall section and a second wall section adjoining the first wall section along a longitudinal axis. The side of the heat shield element facing the inner space forms a cold side of the wall sections to which the cooling medium is applied for cooling purposes. In this case the second wall section can be inclined toward the hot side with respect to the first wall section. Depending on the angle of inclination, different installation or operating situations of the heat shield element can therefore be implemented.

With an annular combustion chamber of a gas turbine which is equipped with what is known as a combustion chamber liner for limiting and for guiding the flow of hot gas to a downstream turbine, for example, the heat shield element can be used as a segment of the gas turbine liner. With a plurality of such heat shield elements, a full areal lining of the combustion chamber of the annular combustion chamber can be implemented over the full circumference of the annular combustion chamber. With annular combustion chambers of said type, namely, the hot gas stream from the burner outlet in the direction of the turbine has to be diverted by an angle. The combustion chamber liner, among other things, is provided for this diversion purpose. This is possible particularly easily with a combustion chamber liner that has one or more locally selectively coolable heat shield elements. The first wall section, which faces the burner outlet and is directly exposed to the hot combustion gas on the hot side, requires increased cooling power in order to guarantee reliable operation of the combustion chamber. By means of the invention, however, a selective cooling of said thermally heavily loaded wall section of the heat shield element is guaranteed. A heat shield element with assigned flow element is therefore particularly suitable for a heat-resistant combustion chamber lining, since the diversion angle and the local cooling power requirement can be tailored to the respective conditions on account of the first wall section and the second wall section inclined with respect thereto. With this arrangement, in addition, a particularly advantageous inflow of the hot gases produced by the combustion process into a turbine disposed downstream of the combustion chamber can be achieved.

The heat shield element is preferably embodied as a single-shell hollow vessel, which hollow vessel has a cavity in which the flow element is disposed. This structural embodiment permits a reliable insertion and accommodation of the flow element during the assembly of the combustion chamber or during the retrofitting of a combustion chamber with a flow element for cooling adjustment.

Furthermore the flow element is protected against exposure to hot gas because it is located in the cavity which is closed off toward the hot side. The flow element is appropriately designed for an optimally efficient and adjusted cooling and placed in the cavity in such a way that high flow velocities result in the thermally heavily loaded wall sections. In this arrangement the half-shell of the single-shell hollow vessel is oriented with the open side toward the combustion chamber wall, with the result that the cavity at the same time forms a subspace of the inner space which is subjected to the action of cooling medium for cooling purposes.

In a particularly preferred embodiment the flow element is secured to the combustion chamber wall with a positive fit. The positive fit leads to an arrangement of heat shield element, flow element and combustion chamber wall which has particularly low susceptibility mechanically with regard to vibrations. The positive fit between combustion chamber wall and flow element also facilitates assembly and allows the flow element to be maneuvered precisely into a predetermined position and fixed so that the flow element can perform the desired cooling function in the inner space.

To achieve a particularly high overall level of efficiency of the combustion chamber, the heat input into the cooling medium is advantageously recovered for the actual energy conversion process in the combustion chamber. Toward that end, provision is advantageously made for the cooling air used as the cooling medium in the inner space and heated up during the cooling of the combustion chamber to be injected into the combustion chamber, with the preheated cooling air being able to serve as exclusive or additional combustion air. In order to supply the discharging cooling medium accordingly to the combustion process in the combustion chamber, the inner space is preferably connected on the output side for optimized flow to a collecting space which for its part is located upstream of the combustion chamber on the air side. Via said collecting space the heated cooling medium can if necessary be mixed by a choke device with the remaining compressor mass flow and supplied to the combustion process, thereby achieving a closed-loop air cooling circuit.

The flow element for selective adjustment of the cooling medium stream in the inner space is preferably detachably connected to the combustion chamber wall. The connection can be achieved, for example, by means of a screw connection, with the flow element being secured from outside through the combustion chamber wall or from inside, i.e. within the inner space. However, the connection can also be achieved by means of a mechanical latching arrangement. The heat shield element and the combustion chamber wall have corresponding connecting and/or securing elements in order to achieve a detachable connection.

The flow element is also preferably made of metal, in particular a metal sheet or a metal plate or a metal shaped part, e.g. a casting.

The above-mentioned combustion chamber is preferably part of a gas turbine.

BRIEF DESCRIPTION OF THE DRAWINGS

The invention will be explained in more detail below with reference to a drawing, in which, in a simplified representation that is not to scale.

DETAILED DESCRIPTION OF THE INVENTION

Figure 1:
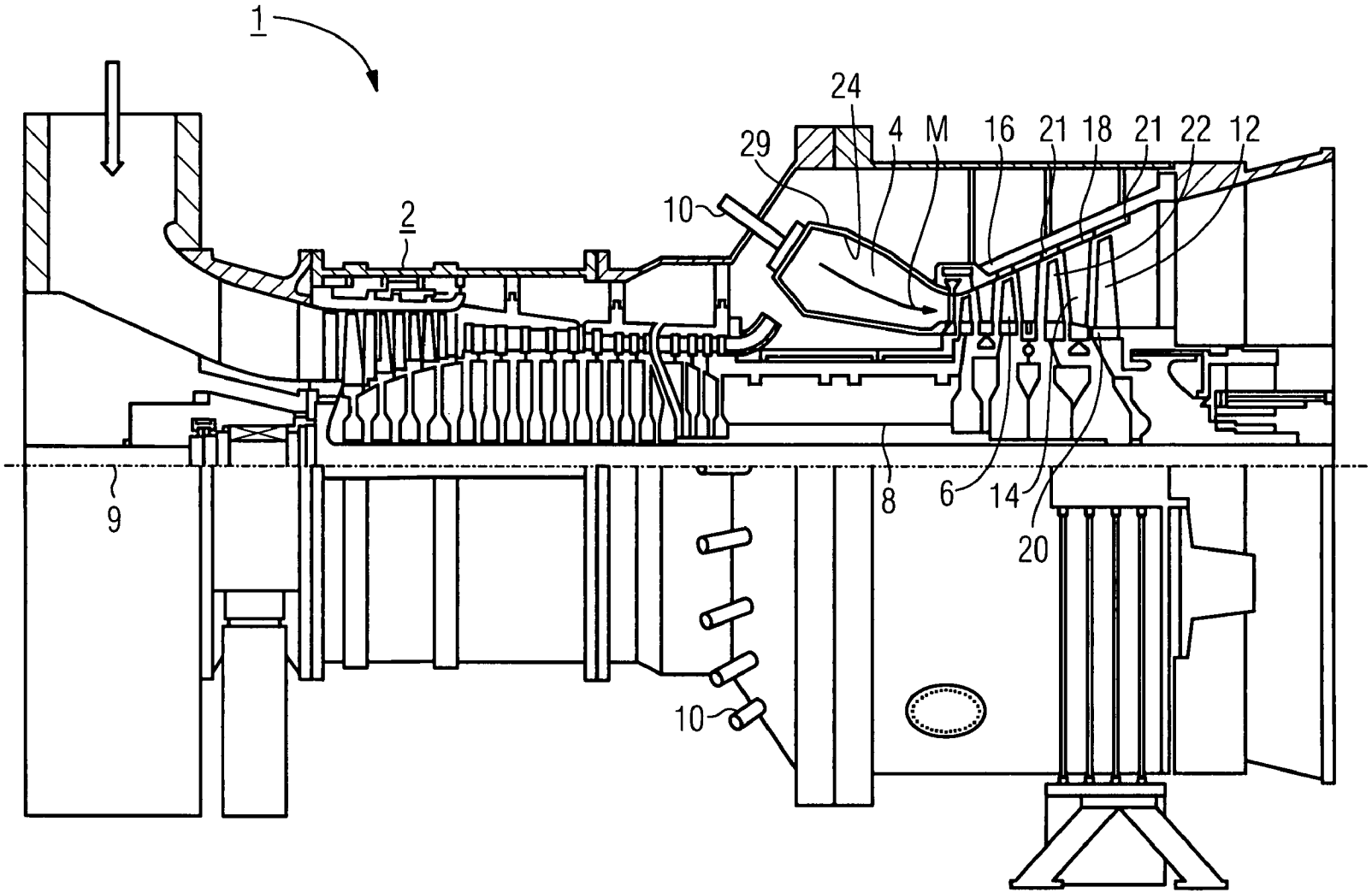
FIG. 1 shows a half section through a gas turbine.

Identical parts are provided with the same reference characters in all the figures.

The gas turbine 1 according to FIG. 1 has a compressor 2 for combustion air, a combustion chamber 4 and a turbine 6 for driving the compressor 2 and a generator or machine (not shown). In addition, the turbine 6 and the compressor 2 are disposed on a common turbine shaft 8, also referred to as a turbine rotor, to which the generator or, as the case may be, the machine is also connected and which is rotatably mounted about its central axis 9. The combustion chamber 4 implemented in the manner of an annular combustion chamber is equipped with a plurality of burners 10 for combusting a liquid or gaseous fuel.

The turbine 6 has a number of rotatable blades 12 connected to the turbine shaft 8. The blades 12 are disposed in an annular cascade shape on the turbine shaft 8 and thus form a number of blade rows. The turbine 6 further comprises a number of stationary guide vanes 14 which are also secured in an annular cascade shape so as to form series of guide vanes on an inner housing 16 of the turbine 6. In this arrangement the blades 12 serve to drive the turbine shaft 8 by pulse transmission from the hot medium, the working medium M, flowing through the turbine 6. The vanes 14 on the other hand serve to direct the flow of the working medium M between, in each case, two successive blade series or blade cascades viewed in the direction of flow of the working medium M. A consecutive pair consisting of a cascade of vanes 14 or a series of vanes and a cascade of blades 12 or a series of blades is in this case also referred to as a turbine stage.

Each vane 14 has a platform 18, also referred to as a vane root, which is disposed as a wall element for fixing the respective vane 14 on the inner housing 16 of the turbine 6. In this arrangement the platform 18 is a component which is subject to a comparatively high level of thermal loading and which forms the outer boundary of a heating gas channel for the working medium M flowing through the turbine 6. Each blade 12 is similarly secured to the turbine shaft 8 via a platform 20, also referred to as a blade root.

A guide ring 21 is disposed on the inner housing 16 of the turbine 6 between each of the spaced-apart platforms 18 of the vanes 14 of two adjacent series of vanes. The outer surface of each guide ring 21 is also exposed here to the hot working medium M flowing through the turbine 6 and separated from the outer end 22 of the opposite blade 12 by a gap in the radial direction. The guide rings 21 disposed between adjacent series of vanes are used here in particular as cover elements which protect the inner wall 16 or other integral housing parts from thermal overload due to the hot working medium M flowing through the turbine 6.

The combustion chamber 4 is bounded by a combustion chamber housing 29, a combustion chamber wall 24 being formed on the combustion chamber side. In the exemplary embodiment the combustion chamber 4 is embodied as what is referred to as an annular combustion chamber, wherein a plurality of burners 10 disposed in the circumferential direction around the turbine shaft 8 open out into a common ring-shaped combustion chamber space. Moreover the combustion chamber 4 is also embodied in its entirety as a correspondingly annular structure which is positioned around the turbine shaft 8.

Figure 2:
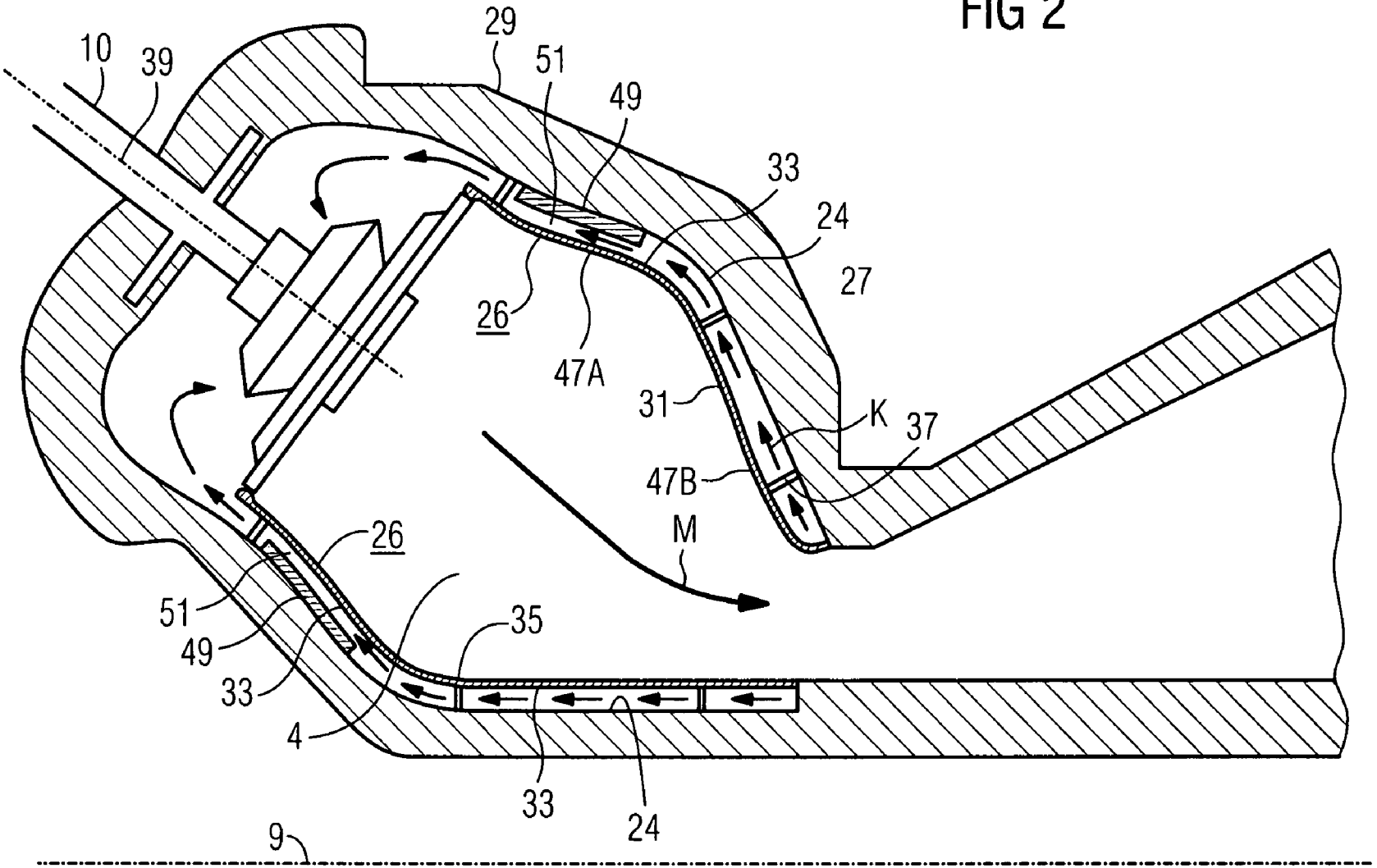
FIG. 2 shows a section through a combustion chamber.

To further clarify the embodiment of the combustion chamber 4, FIG. 2 shows the combustion chamber 4 in a sectional view as it continues in a toroidal manner around the turbine shaft 8. As can be seen from the diagram, the combustion chamber 4 has an initial or inflow section into which the end of the outlet of the respective assigned burner 10 opens. Viewed in the direction of flow of the working medium M, the cross-section of the combustion chamber 4 then narrows, with account being taken of the resulting flow profile of the working medium M in this area. On the outlet side, in the longitudinal cross-section the combustion chamber 4 has a curve which assists the discharge of the working medium M from the combustion chamber 4, resulting in a particularly high pulse and energy transmission to the following first series of blades seen from the flow side. When flowing through the combustion chamber from a direction essentially parallel to the burner axis 39, the working medium M is diverted in a direction parallel to the central axis 9.

To achieve a comparatively high level of efficiency, the combustion chamber 4 is designed for a comparatively high temperature of the working medium M of around 1200° C. to 1500° C. In order to achieve a comparatively long operating life even with these unfavorable operating parameters for the materials, the combustion chamber wall 24 is provided with a combustion chamber lining formed from heat shield elements 26 on its side facing the working medium M. The heat shield elements 26 are secured to the combustion chamber wall 24 via fixing means 37, with a gap being left whose dimension corresponds at the same time to the dimension of the inner space 27 vertically to the combustion chamber wall 24. Each heat shield element 26 is provided with a particularly heat-resistant protective layer 31 on the side facing the working medium M, that is to say on its hot side 35. On account of the high temperatures in the interior of the combustion chamber 4 a cooling system is additionally provided for the heat shield elements 26. In this instance the cooling system is based on the principle of convective cooling, where cooling medium, e.g. cooling air, is guided along a surface of the component requiring cooling. Alternatively the cooling system can be designed for impingement cooling, where cooling air as the cooling medium K is blasted under sufficiently high pressure at a plurality of points against the component to be cooled vertically to a component surface.

The cooling system is designed with a simple structure to provide a reliable, comprehensive application of cooling air K to the entire area of the heat shield elements 26 and in addition to ensure a particularly low cooling medium pressure loss. Toward that end, the heat shield elements 26 are cooled from their cold side 33 by the cooling air K which is supplied to an intermediate space 27 formed between the heat shield element 26 by means of suitable supply lines (not shown in further detail) and, depending on the cooling mechanism, directed onto or, as the case may be, along the cold side 33 of a respective heat shield element 26.

The principle of the very advantageous closed-loop air cooling circuit is applied here. Following completion of the cooling function on the heat shield elements 26, the heated air is used completely for combusting in the burner 10 and the heat also conveyed is recirculated as well; the closed-loop air cooling circuit thus permits higher power/efficiency levels as well as lower $NO_x$ emissions than, for example, open-loop air cooling. With the open-loop air cooling system the "cold" cooling air is mixed with the heating gas flow downstream of the combustion, thereby leading to a lower gas turbine efficiency and higher hazardous substance values.

A combustion chamber lining comprising a plurality of temperature-resistant and shape-reinforced heat shield elements 26 is provided for a both temperature- and vibration-resistant design of the combustion chamber 4 embodied as an annular combustion chamber. In this way a full-coverage, largely leak-free combustion chamber lining is formed in the annular space, said lining commonly being referred to as a combustion chamber liner.

A flow element 49 is inserted in the inner space 27 formed between heat shield element 26 and combustion chamber wall 24. Said flow element 49 is secured with a positive fit to the combustion chamber wall 24, e.g. by means of a suitable mechanical latching element or a screw connection. In this arrangement the flow element 49 is disposed in such a way that a thermally heavily loaded first wall section 47A of the heat shield element 26, as shown here in the vicinity of the burner 10, can be cooled more intensively. In the inner space 27, the flow element 49 produces a flow channel 51 for the cooling medium K with a reduced flow cross-section compared with upstream of the flow element 49, i.e. in the area of the less thermally loaded wall section 47B compared with the first wall section 47A. This leads to a selectively adjustable local increase in the flow velocity of the cooling medium in the flow channel 51 and hence to an increase in heat transfer from the thermally heavily loaded wall section 47A to the cooling medium K.

In this arrangement the positive fitting flow elements 49 on the combustion chamber wall 24 can advantageously also be fitted subsequently, i.e. in the course of an inspection measure on an already existing combustion chamber 4, either from outside through the housing 29 or also from inside on the combustion chamber wall 24.

Figure 3:
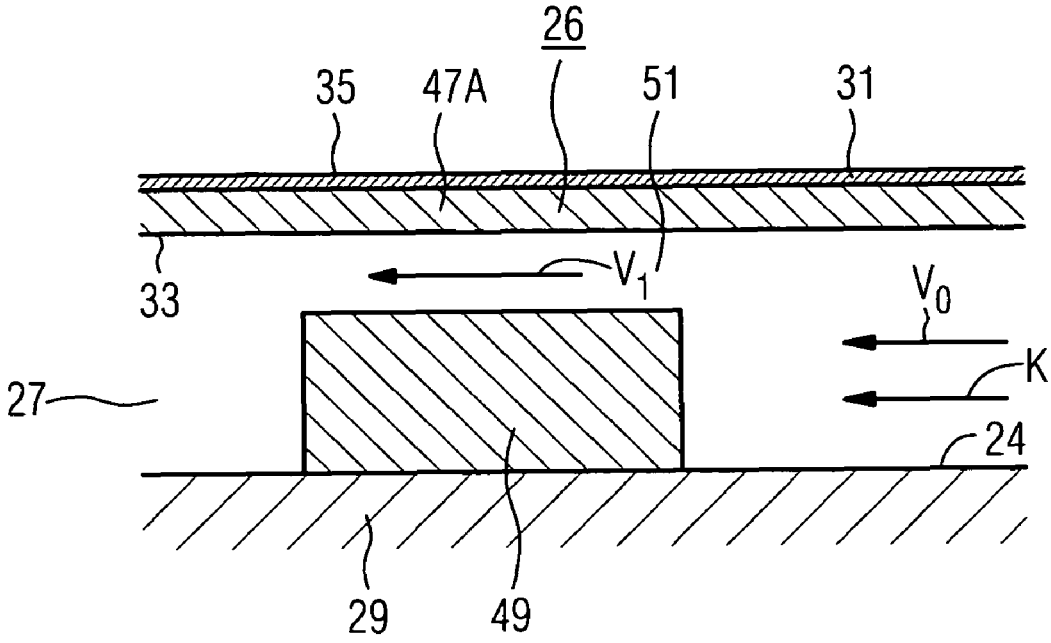
FIG. 3 shows a section of the combustion chamber in the area of the combustion chamber wall with a flow element in a sectional view.

FIG. 3 shows a section of the combustion chamber 4 in the area of the combustion chamber wall 24 with a flow element 49 in a sectional view. The heat shield element 26 is spaced at a distance from the combustion chamber wall 24 and forms an inner space 27 which can be exposed to a cooling medium K. A flow element 49 is inserted in the inner space 27 to provide selective adjustment of a cooling medium stream. In the exemplary embodiment shown the flow element 49 is essentially cube-shaped and mounted with a positive fit on the combustion chamber wall 24. This achieves a reduction in the flow cross-section for the cooling medium stream in the area of the flow element 49, a flow channel 51 for cooling medium K being formed by the flow element 49, in which flow channel 51 the flow velocity $v_1$ of the cooling medium stream is increased compared with the flow velocity $v_0$ upstream of the flow element 49. As a result of the local increase in the flow velocity in the flow channel 51, an increase in heat transfer is produced from the hot side 35 of the heat shield element 26 to the cooling medium K, for example cooling air. A thermally particularly heavily loaded wall section 47A of the heat shield element 26 can therefore be cooled locally in a selective manner with a higher cooling power. The flow element 49 permits a cooling adjustment, the gap dimension in the inner space 27 between the cold side 33 and the combustion chamber wall 24 being adjusted with regard to the cooling requirement. In addition the heat shield element 26 can have a high temperature resistant protective layer on the hot side 35 in preparation for exposure to very hot combustion gases. A protective layer 31 of said kind can be, for example, a ceramic heat-insulating layer.

Figure 4:
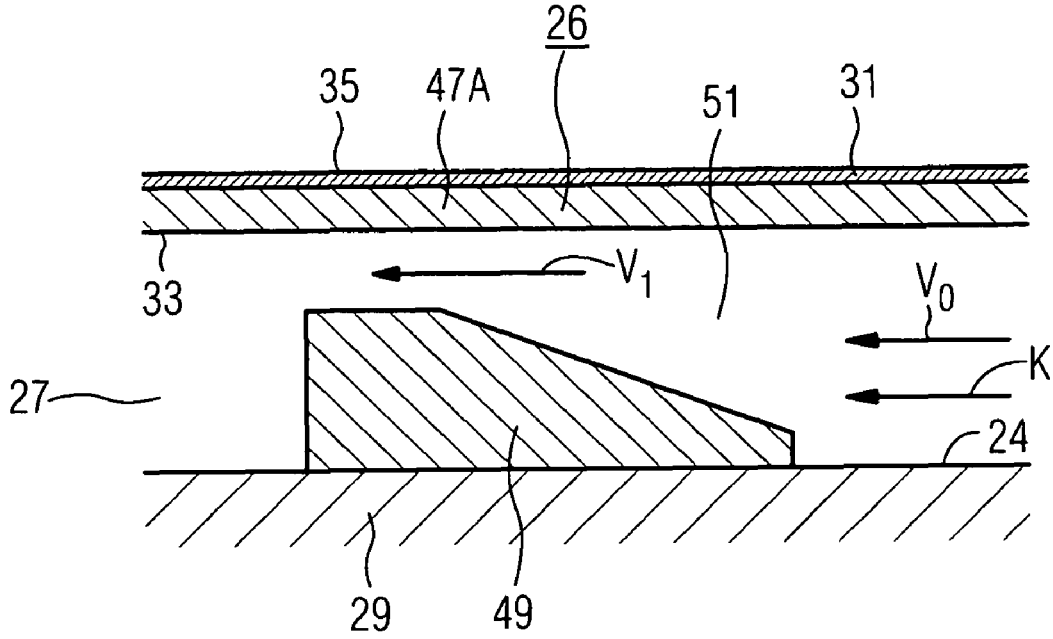
FIG. 4 shows a section of the combustion chamber with a modified flow element compared to FIG. 3 in a sectional view.

Compared with FIG. 3, FIG. 4 shows an exemplary embodiment having a modified flow element 49 which is inserted into the inner space 27. The flow channel 51 for the cooling medium K formed in the inner space 27 by the flow element 49 varies in the flow direction. The flow cross-section in the flow channel 51 initially decreases continuously in the flow direction and reaches a value which subsequently remains constant for a certain flow path, after which it again increases to a greater flow cross-section. This approximately wedge-shaped profile of the flow element 49 leads in the area of the linear increase to a correspondingly proportionally increasing flow velocity $v_1$ in the flow channel 51. Through structural configuration and geometric shaping of the flow element 49 an adjustment to the respective cooling task can accordingly be performed in the inner space 27.

To achieve a both temperature- and vibration-resistant design of the combustion chamber 4 embodied as an annular combustion chamber, a combustion chamber lining is provided in a preferred embodiment, as described in more detail below with reference to FIG. 5 and FIG. 6, with a plurality of both temperature-resistant and shape-reinforced heat shield elements 26. In this way a full-coverage, largely leak-free combustion chamber lining is formed in the annular space, commonly referred to as a combustion chamber liner, which furthermore can be cooled particularly efficiently, because locally selectively, by means of the flow element 49 in the inner space 27.

The vibration behavior of the heat shield element 26 is favorably influenced here by a selective geometric contouring, with the result that the natural vibration modes of the heat shield element 26 are increased with respect to the excitation frequency of a combustion vibration. Resonance effects caused by positive feedback can thus be avoided. For illustration purposes, FIG. 5 shows an exemplary embodiment of a heat shield element 26 in a simplified perspective view and FIG. 6 shows a somewhat magnified view of the front side surface of the heat shield element 26 depicted in FIG. 5. The heat shield element 26 extends along a longitudinal axis 43 and a transverse axis 45 running vertically with respect to the longitudinal axis 43. The heat shield element 26 comprises a wall 47 which has a hot side 35 with a hot side surface 55 which can be subjected to the action of the hot working medium M. A cold side 33 is provided opposite the hot side 35 of the wall 47. The wall 47 has two wall sections 47A, 47B, a first wall section 47A being disposed ahead of a second wall section 47B along the longitudinal axis 43 in the flow direction of the working medium M. The second wall section 47B is also inclined with respect to the first wall section 47A in the direction of the hot side 35, with the result that the second wall section 47B forms an angle of inclination with the longitudinal axis 43. In this case the inclination is set in such a way that a structural adjustment to the lining of a combustion chamber wall 24 (cf. FIG. 2) is achieved. Surface regions 57A, 57B are formed on the hot side surface 55 in the first wall section 47A. Each of the surface regions 57A, 57B has a non-planar, that is to say curved, surface contour along the longitudinal axis 43 and along the transverse axis 45. In this case the surface region 57A is curved in a concave shape in the direction of the transverse axis 45 and curved in a convex shape in the direction of the longitudinal axis 45, such that a saddle surface 59 having a saddle point $P_S$ is formed in the surface region 57A. The second surface region 57B has a spherical surface contour and is disposed after the surface region 57A along the longitudinal axis 43 in the flow direction of the working medium M, e.g. the hot combustion gas, the surface region 57A transitioning into the second surface region 57B via a transition region 61.

An improvement in the mechanical properties, in particular the rigidity, of the heat shield element 26 is achieved through the shaping by surface contouring in the surface regions 57A, 57B of the first wall section 47A. As a result the natural vibration modes of the heat shield element 26 are selectively influenced with respect to the excitation frequency of a combustion vibration. The increased rigidity of the heat shield element 26 is achieved by shape reinforcement and leads directly to an increase in the natural vibration mode with respect to the relevant excitation frequency of a combustion vibration. As a result of this increase in rigidity through geometric embodiment of the hot side surface according to the invention, the heat shield element 26 is considerably superior to the conventional planar heat shield elements. In this case a two-dimensional curved surface contour, i.e. both along the longitudinal axis 43 and along the transverse axis 45, is applied to the surface region 57A, 57B. A curved surface contour can also be applied here on the cold side 33 or on the surfaces in the second wall section 47B, where this leads to a further improvement in vibration behavior with regard to a low susceptibility with respect to resonance excitation caused by usual combustion vibration frequencies. Surprisingly, however, it has been shown that even an adequate shape reinforcement as a result of a two-dimensional surface contouring of the hot side surface 55 in the first wall section yields good results. Thus, a conventional—essentially planar—heat shield element has a typical natural frequency at, for example, 380 Hz, whereas given otherwise identical dimensions an increase in the natural frequency to 440 Hz was achieved by means of the contouring according to the invention. Even concave and/or convex surface contours with only small curve radii produce an increase in the rigidity of the heat shield element 26.

Figure 5:
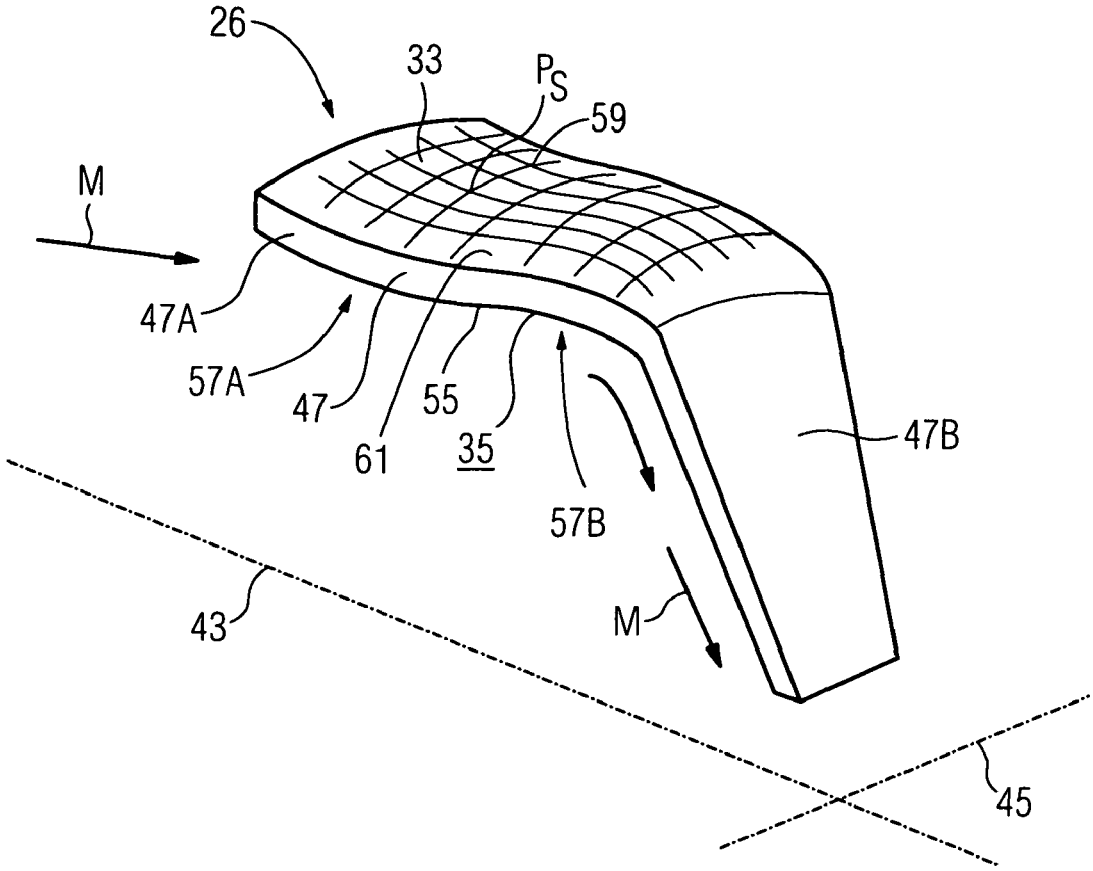
FIG. 5 shows a heat shield element in a perspective view.
Figure 6:
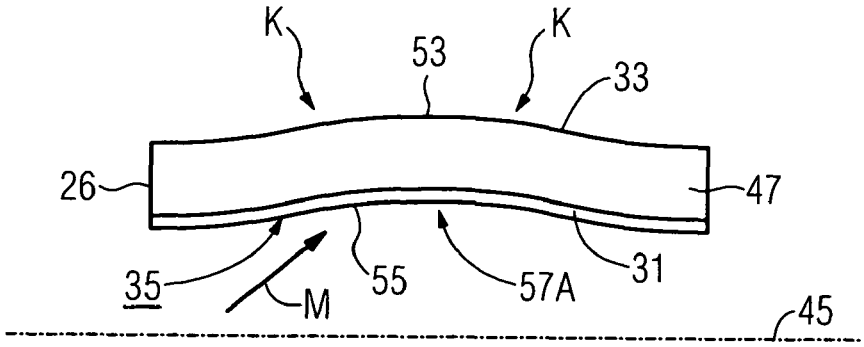
FIG. 6 shows a view of the heat shield element shown in FIG. 5 along its longitudinal axis onto the front side.

The implementation according to the exemplary embodiment shown in FIG. 5 comprising a combination of saddle surface contour in the surface region 57A and spherical-concave surface contour in the surface region 57B proves particularly favorable. Through this shaping of the hot side surface 45, an S-shaped contour is achieved in the first wall section 47A viewed linearly in the direction of the longitudinal axis, whereas the second wall section 47B is embodied as largely planar. By this means a favorable flow guidance of the working medium M is achieved when the heat shield element 26 is used in a combustion chamber 4. In particular with an annular combustion chamber of a gas turbine, a particularly uniform and low flow loss diversion of the hot working medium M—as shown in FIG. 2—is achieved with subsequent inflow into the turbine blade array. Moreover, a direct action of flames on the hot side surface 55 is avoided as a result of the S shape. In addition, this surface contour produces an improved flowing of the working medium M over and along the hot side surface 55 from the first wall section 47A to the second wall section 47B.

In order to implement the heat shield element 26 so as to be particularly resistant with respect to exposure to hot working medium M, a heat-resistant protective layer 31 is applied to its hot side 35, e.g. a ceramic high-temperature-resistant heat-insulating layer. For cooling purposes a cooling surface 53 is formed on the cold side 33, to which cooling surface 53 a cooling medium K, e.g. cooling air, is applied. The cooling medium stream of the cooling medium K is selectively adjusted here in that in the case of installation the or each heat shield element 26 forms an inner space 27 which can be exposed to the cooling medium K (cf. FIGS. 2, 3 and 4) and in which a flow element 49 is inserted. Thus, when the heat shield element 26 is used for lining a combustion chamber 4, both the inclusion and the flow direction of the hot working medium M and the protection of other, possibly less heat-resistant, parts or components, such as, for example, the combustion chamber wall 24, against overheating or thermal destruction are ensured, a selective cooling of the particularly temperature-stressed areas being achieved when the flow element 49 is used.

With a shape-reinforced heat shield element 26 a thermally heavily loadable and readily coolable component is therefore specified, by means of which an areal lining, in particular a full-coverage combustion chamber lining, can therefore be implemented in an easy manner, which lining has at the same time a particularly low susceptibility to combustion vibrations owing to the shape reinforcement.

Figure 7:
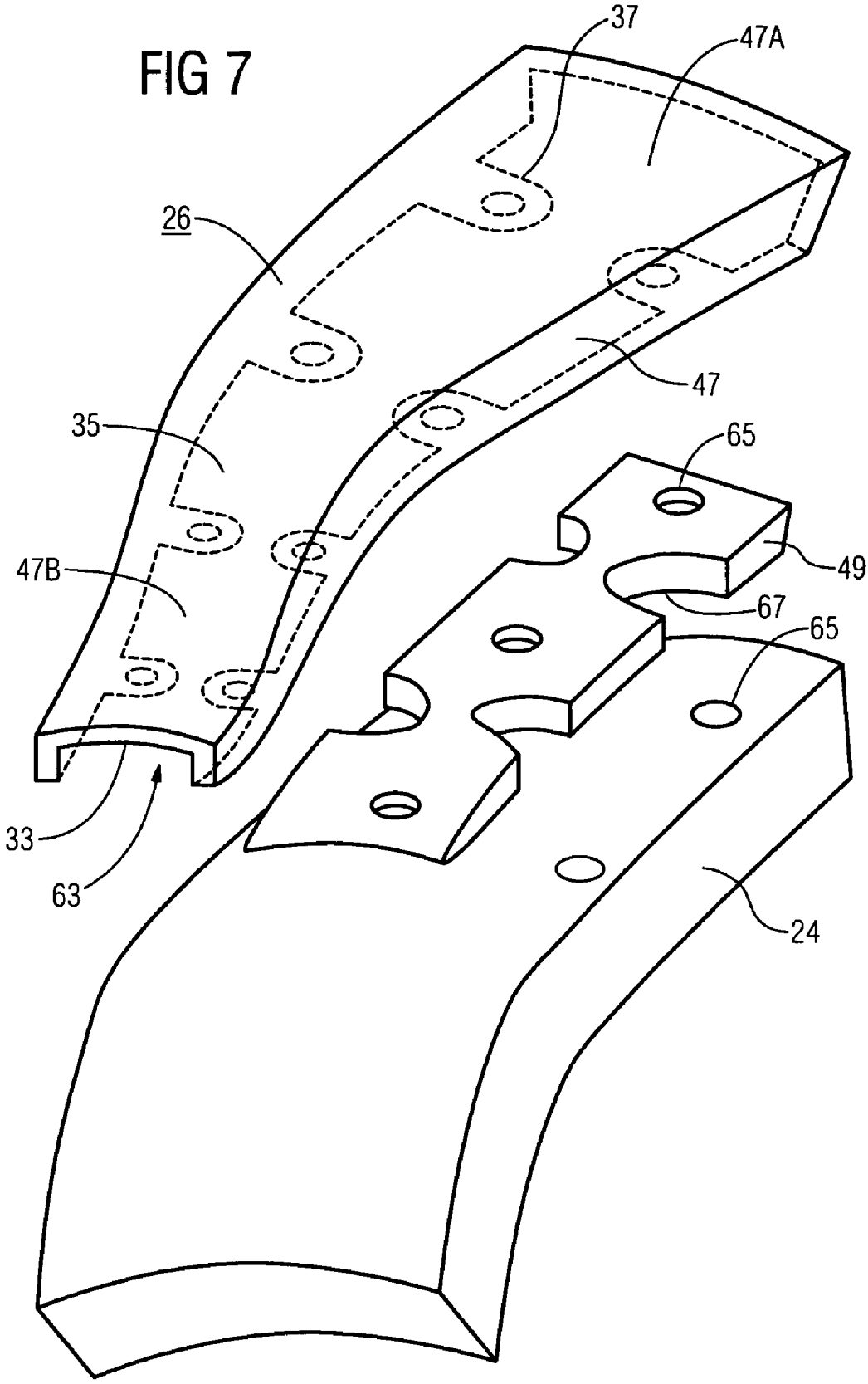
FIG. 7 shows a section of a combustion chamber wall with heat shield element and with flow element in a perspective exploded view.

FIG. 7 shows a combustion chamber wall 24 with heat shield element 26 and with flow element 49 in a perspective exploded view. The heat shield element 26 is provided as a single-shell hollow vessel with a cavity 63. The cavity 63 opens out in the direction of the combustion chamber wall 24, with the result that in the installed condition the flow element 49 is encompassed by the single-shell hollow vessel. The heat shield element 26 has a first wall section 47A and a second wall section 47B inclined with respect to the first wall section 47A. The heat shield element 26 can be mounted on the combustion chamber wall 24 via fixing elements 37, e.g. by means of a screw connection, with a fixing element 37 being assigned a hole 65 drilled in the combustion chamber wall 24. In this arrangement the hole 65 can optionally also be embodied as a tapped hole with a thread. In the area where the heat shield element 26 is mounted on the combustion chamber wall 24 the flow element 49 has corresponding cutouts 67. The flow element 49 is embodied as approximately wedge-shaped in order to produce an increase in the flow velocity of the cooling medium K in the area of the thermally more heavily loaded first wall section 47A. In this arrangement the flow element 49 is detachably connected to the combustion chamber wall 24 so as to enable a replacement or conversion using other flow elements 49 to be carried out if the cooling function is modified. The flow element 49 is attached here while a positive fit is maintained between the flow element 49 and the combustion chamber wall 24 in order to guarantee mechanical stability on the one hand and precise adjustment of the flow cross-section for the cooling medium K on the other hand. For fixing on the combustion chamber wall, the flow element 49 is provided with holes 65 which enable the flow element 49 to be screwed to the combustion chamber wall 24 from outside or from inside. The flow element 49 is a metal part, in particular a metal sheet or a metal shaped part.

The invention claimed is:

1. A combustion chamber for a gas turbine, comprising: a combustion chamber wall; a liner formed from a plurality of heat shields on an inside of the combustion chamber wall; an inner space formed between the heat shield elements and the combustion chamber wall and exposed to a cooling medium, wherein said liner is made from a leak-free material such that the inner space is configured to direct the cooling medium along a cold-side of the liner and within the inner space, and to a burner for combustion in the burner upon exiting the inner space; and a flow element arranged in the inner space for selective adjustment of a cooling medium stream, the flow element arranged on the combustion chamber wall, wherein a longer side of the flow element is adjacent and in contact with the combustion chamber wall such that the longer side is defined by a plane that is substantially parallel to and encompasses the combustion chamber wall; wherein each respective heat shield has a surface region with a surface contour curved along a longitudinal axis in a flow direction of the cooling medium and a transverse axis perpendicular to the longitudinal axis; and wherein the flow element has a wedge-shaped profile such that a flow cross-sectional area for the cooling medium within the inner space between an outer surface of the flow element and the heat shield elements is configured to continually decrease for at least a portion of the profile.

2. The combustion chamber as claimed in claim 1, wherein a flow channel for cooling medium is formed by the flow element causing a flow velocity of the cooling medium stream to be increased compared with the flow velocity upstream of the flow element.

3. The combustion chamber as claimed in claim 1, wherein a heat shield element is assigned a respective flow element for the purpose of cooling a thermally heavily loaded wall section of the heat shield element.

4. The combustion chamber as claimed in claim 3, wherein the heat shield element is a single-shell hollow vessel with a cavity in which the flow element is disposed so that the flow element is encompassed by the single-shell hollow vessel and the heat shield element is mounted on the combustion chamber wall.

5. The combustion chamber as claimed in claim 1, wherein the flow element is mounted on the combustion chamber wall using a mechanical latching element or a screw connection.

6. The combustion chamber as claimed in claims 1, wherein the flow element is detachably connected to the combustion chamber wall.

7. The combustion chamber as claimed in claim 1, further comprising a flow element made of metal.

8. The combustion chamber as claimed in claim 7, wherein the metal flow element is made of a metal sheet or a metal casting.

9. A gas turbine having a combustion chamber, comprising: a combustion chamber wall; a liner formed from a plurality of heat shields on an inside of the combustion chamber wall; a liner formed from a plurality of heat shields on an inside of the combustion chamber wall; an inner space formed between the heat shield elements and the combustion chamber wall and exposed to a cooling medium, wherein said liner is made from a leak-free material without openings in the liner such that the inner space is configured to direct the cooling medium along a cold side of the liner and within the inner space, and to a burner for combustion in the burner upon exiting the inner space; and a flow element having a wedge-shaped profile is arranged in the inner space for selective adjustment of a cooling medium stream, the flow element arranged on the combustion chamber wall, wherein a longer side of the flow element is adjacent and in contact with the combustion chamber wall such that the longer side is defined by a plane that is substantially parallel to and encompasses the combustion chamber wall; and wherein each respective heat shield has a surface region with a surface contour curved along a longitudinal axis in a flow direction of the cooling medium and a transverse axis perpendicular to the longitudinal axis.

10. A flow element arranged in a flow channel between a combustion chamber wall and a heat shield element in a combustion chamber of a gas turbine, comprising: a surface of the flow element having a wedge-shaped profile is located near a cold side of the heat shield such that the flow channel becomes more narrow, said flow channel configured to direct a cooling medium along the cold side of the heat shield and within the flow channel and to a burner for combustion in the burner upon exiting the flow channel; a surface contour of the surface adapted to approximately match a surface contour of the cold side of the heat shield element, wherein a longer side of the flow element and the surface is adjacent and in contact with the combustion chamber wall such that the longer side is defined by a plane that is substantially parallel to and encompasses the combustion chamber wall; and wherein the heat shield element has a first surface region with a surface contour curved along a longitudinal axis in a flow direction of the cooling medium and a transverse axis perpendicular to the longitudinal axis, and a second surface region with a spherical-concave contour curved along the longitudinal axis and the transverse axis, said second surface region positioned downstream of the first surface region.

11. The flow element as claimed in claim 10, wherein the cooling medium flowing in the flow channel is caused to accelerate as the cooling medium flows by the surface.

12. The flow element as claimed in claim 10, wherein the flow element is approximately rectangular in shape and the surface forms the longer side of the rectangle.

13. The flow element as claimed in claim 10, wherein a heat shield element is assigned a respective flow element for the purpose of cooling a thermally heavily loaded wall section of the heat shield element.

14. The flow element as claimed in claim 10, wherein the heat shield element is a single-shell hollow vessel with a cavity in which the flow element is disposed so that the flow element is encompassed by the single-shell hollow vessel and the heat shield element is mounted on the combustion chamber wall.

15. The flow element as claimed in claim 10, wherein the flow element is approximately triangular in shape and the surface forms the longer side of the triangle.

16. The flow element as claimed in claim 10, wherein the surface is approximately parallel to the cold surface of the heat shield element.

* * * * *